United States Patent [19]

Miller

[11] Patent Number: 4,785,887

[45] Date of Patent: Nov. 22, 1988

[54] ADJUSTABLE FIRE SPRINKLER HEAD SUPPORT SYSTEM

[75] Inventor: Peter Miller, Arlington, Va.

[73] Assignee: Lifesaving Systems, Inc., Alexandria, Va.

[21] Appl. No.: 21,336

[22] Filed: Mar. 3, 1987

[51] Int. Cl.[4] ..... A62C 37/08

[52] U.S. Cl. ..... 169/37; 239/587; 169/51

[58] Field of Search ..... 169/37–41, 169/90, 51, 17, 16, 5; 138/106, 107; 239/587; 248/65, 70, 342, 343

[56] References Cited

U.S. PATENT DOCUMENTS

| | | | |
|---|---|---|---|
| 955,911 | 4/1910 | Aegmuller et al. . | |
| 2,164,051 | 6/1939 | Brunson . | |
| 2,174,747 | 10/1939 | Hueglin | 248/343 |
| 2,305,015 | 12/1942 | Langer | 248/343 X |
| 2,313,131 | 3/1943 | Elias | 248/343 X |
| 2,967,928 | 1/1961 | Wolar | 248/343 X |
| 3,226,536 | 12/1965 | Atkin et al. | 248/180 X |
| 3,265,087 | 9/1966 | Livingston . | |
| 3,414,412 | 1/1969 | Applegate . | |
| 3,574,448 | 4/1971 | Pain et al. . | |
| 3,637,244 | 1/1972 | Strizki . | |
| 3,815,821 | 6/1974 | Metcalfe . | |
| 4,007,877 | 2/1977 | Jackson et al. | 169/37 X |
| 4,019,581 | 4/1977 | Diggs . | |
| 4,684,092 | 8/1987 | Reiker | 248/343 X |

FOREIGN PATENT DOCUMENTS

| | | | |
|---|---|---|---|
| 909024 | 10/1962 | United Kingdom | 239/587 |

OTHER PUBLICATIONS

J. Strong, Ph.D., et al., "Procedures in Experimental Physics", *Prentice-Hall Physics Series*, Chapter XIV, pp. 584–591, Oct. 1938.

*Primary Examiner*—Joseph F. Peters, Jr.
*Assistant Examiner*—James M. Kannofsky
*Attorney, Agent, or Firm*—Oblon, Fisher, Spivak, McClelland & Maier

[57] ABSTRACT

A sprinkler head is adjustably supported in three dimensions by an assembly including a first bracket having a cut-out and a second bracket having a cut-out. The first bracket has a circumferentially evenly spaced array of three threaded apertures around the cut-out. The second bracket has a similar set of unthreaded holes around its cut-out. Bolts extend through the second bracket and are threaded into the apertures of the first bracket. Nuts on the bolts may be used as stop elements. The second bracket is attached to fingers extending from the downcomer pipe to which the sprinkler head is attached. In a second embodiment, three fingers are provided, and they replace the second bracket. Adjustment of the sprinkler head about two orthogonal axes and along a third orthogonal axis parallel to the downcomer pipe can be achieved by turning the bolts from beneath the false ceiling through which the sprinkler head extends.

11 Claims, 3 Drawing Sheets

ADJUSTABLE FIRE SPRINKLER HEAD SUPPORT SYSTEM

BACKGROUND OF THE INVENTION

1. Field of the Invention

The present invention relates to a system for adjustably supporting a member for movement in three dimensions. More particularly, the present invention relates to a system for adjustably supporting a fire sprinkler head for pivoting about two orthogonal axes and movement along a third orthogonal axis.

2. Brief Description of the Related Art

Most municipal and county building codes require the provision of sprinkler systems in public buildings for spraying water within the interior of the building in case of a fire. Conventionally, the sprinkler systems consist of pipes running horizontally between a load bearing ceiling or roof of a floor or building and a non-load bearing "false" ceiling extending some distance below the load bearing ceiling. Essentially vertically extending downcomer pipes extend, at T-connections, from the horizontal water pipes at regular intervals. The downcomers terminate in fire sprinkler heads which extend to slightly below the level of the false ceiling. It is conventional for the sprinkler system to be installed prior to the installation of the false ceiling, after which the false ceiling is installed, with the sprinkler heads extending through small holes in the false ceiling, cut or otherwise provided for this purpose. It is conventional to provide a decorative collar around the sprinkler head to cover the hole made in the false ceiling for the passage of the sprinkler head.

However, due to tolerances and variations experienced in the construction of the downcomer pipes and false ceilings, it often occurs that the downcomer pipes and false ceilings do not extend precisely transverse to one another. It also often occurs that the false ceiling is slightly higher or lower than expected. As a result, the fire sprinkler head may extend too far from the bottom of the false ceiling, or may not extend entirely therethrough. As a result, it may be impossible to fit the decorative collar flush against the false ceiling; instead, the decorative collar may be spaced from the bottom surface of the false ceiling or angled thereto.

It is therefore desirable to provide some means for three dimensionally adjusting the position of the sprinkler head relative to the false ceiling. It is also desirable that any such adjustment be accomplished from below the false ceiling and with ordinary tools. It is also desirable that the adjustment means be simple and cheap in construction so that it can, if necessary, be assembled by a worker at the job site.

SUMMARY OF THE INVENTION

It is an object of the invention to provide an adjustment assembly for supporting a sprinkler head for adjustment in three dimensions.

It is a further object of the invention to provide a sprinkler head adjustment system which is inexpensive, simple, and which permits adjustment from below a false ceiling.

The above objects are achieved, according to the present invention, by an apparatus for three dimensionally adjustably supporting a member, comprising a first bracket having means for permitting free passage of the member therethrough and three threaded apertures means evenly spaced around the free passage means, a second bracket having means for supporting said member and three holes evenly spaced around the supporting means, three threaded bolts, each bolt loosly passing through one of the holes and being threaded in one of the threaded aperture means, and stop means mounted on each of the three bolts between the first and second brackets, whereby the second bracket may pivot about two orthogonal axes and move along a third orthogonal axis relative to the first bracket within limits established by the stop means.

Preferably, the stop means comprise at least one nut threaded on a respective bolt between the first and second brackets.

Preferably, the first bracket comprises an L-shaped member, wherein the means for permitting free passage comprise a first cut-out in one leg of the L-shape, the first cut-out defining a pair of opposing first ears on opposite sides of the first cut-out, each of the first ears having one of the threaded aperture means.

Preferably, the second bracket is spaced from one leg of the L-shape along the third orthogonal axis and the means for supporting the member comprise a second cut-out in the bracket and defining a pair of opposing second ears on opposite sides of the second cut-out, cooperating holes in the second ears for cooperating with fingers projecting from the member, and threaded means extending through the cooperating holes and fixing the fingers and the second ears to one another, wherein each of the second ears has one of the three holes therein.

According to another feature of the invention, it comprises a pipe member in connection with an apparatus for three dimensional adjustably supporting the pipe member, comprising a first bracket having means for permitting free passage of the member therethrough and three threaded aperture means evenly spaced around the free passage means, three evenly circumferentially spaced fingers extending from the pipe member, each of the fingers having a hole therein, three threaded bolts, each bolt loosly passing through one of the holes and being threaded in one of the threaded aperture means, stop means mounted on each of the three bolts between the fingers and the first bracket, whereby the pipe member may pivot about two orthogonal axes and move along a third orthogonal axis parallel to the length thereof relative to the first bracket, within limits established by the stop means. A sprinkler head is preferably attached to one end of the pipe member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
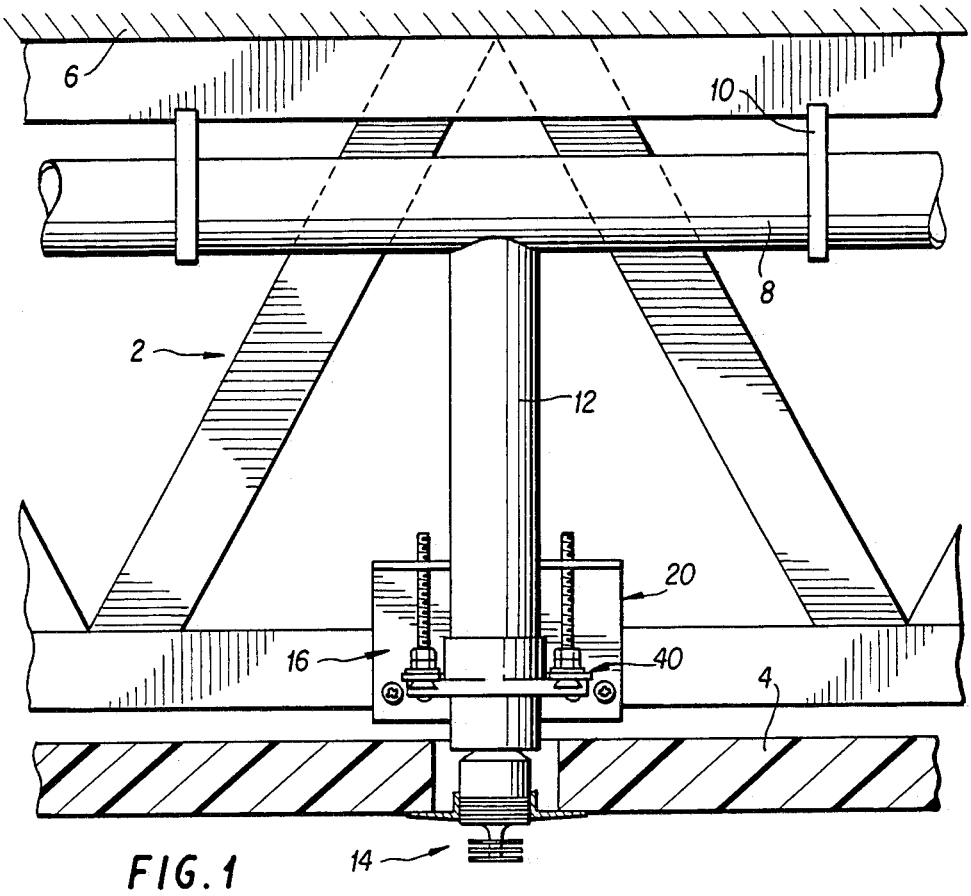
FIG. 1 is an elevational view showing a ceiling arrangement including a fire sprinkler system according to an embodiment of the invention.
Figure 2:
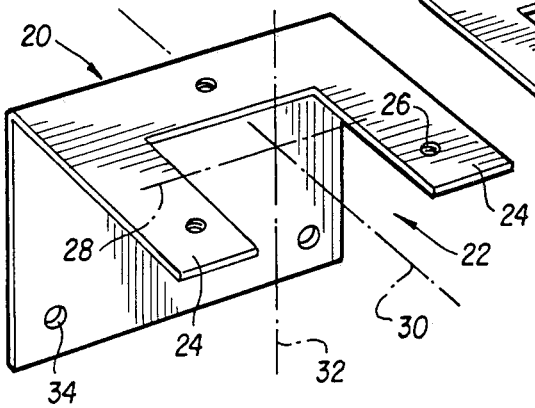
FIG. 2 is an orthogonal view of a first bracket according to the embodiment of FIG. 1.
Figure 3:
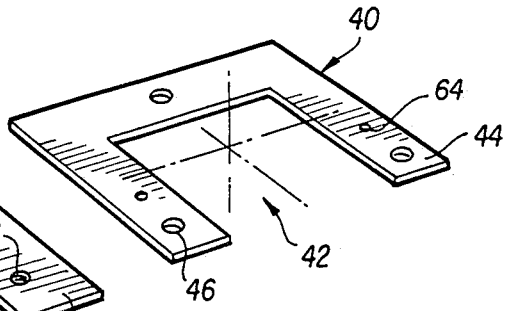
FIG. 3 is an orthogonal view of a second bracket according to the embodiment of FIG. 1.

Referring to FIG. 1, a prefabricated truss work 2 supports a false ceiling 4 from a load bearing ceiling 6. A horizontally extending water pipe 8 in the space between the load bearing ceiling 6 and the false ceiling 4 is supported by the truss work 2 via hangers 10. A downcomer 12 extends from the pipe 8 at a T-connection. The pipe 8 and the downcomer 12 carry high pressure water from a water source (not shown). The downcomer 12 terminates in a conventional sprinkler head 14 such as the Grinnell model 991 or Central Sprinkler Co. model EC 20. An assembly for adjustably supporting the downcomer 12 and sprinkler head 14 for adjustment in three dimensions is generally shown in FIG. 1 at 16.

Referring to FIGS. 2–6, the adjustment assembly includes first bracket 20 which is generally L-shaped. One leg of the bracket 20 has a cut-out 22 which defines a pair of ears 24 on each side thereof. One leg of the first bracket 20 is provided with three threaded aperatures 26 evenly circumferentially spaced about the cut-out. That is, if one imagines a three dimensional coordinate system having a first axis 28, a second axis 30 and a third axis 32 (FIG. 2), with the axes 28 and 30 defining a plane substantially parallel to the one leg of the bracket 20, then the threaded apertures 26 are circumferentially spaced about the third axis 22 by angles of 120°. Two of the threaded apertures 26 are symmetrically positioned about the axis 30 at the ends of the two first ears 24.

Holes 34 in the other leg of the first bracket 20 are used for attaching the first bracket to the truss work 2.

According to this embodiment, there is a second bracket 40 which is essentially planar. Both the first bracket 20 and the second bracket 40 are preferably made of 12 gauge sheet steel. The bracket 40 has a second cut-out 42 defining opposing ears 44. Three holes 46 are formed in the bracket at evenly circumferentially spaced positions, as defined with reference to the first bracket 20. Two of the holes 46 are symmetrically placed at the ends of the second ears 44.

Figure 5:
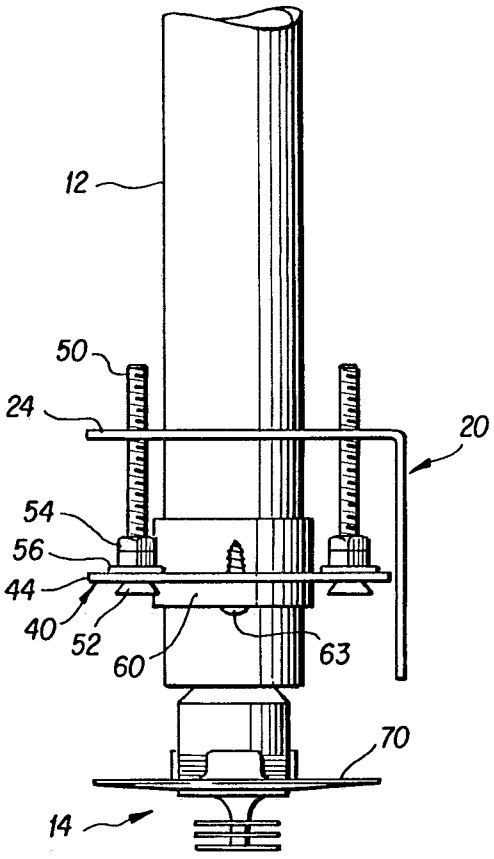
FIG. 5 is a side view of the embodiment of FIG. 1.
Figure 4:
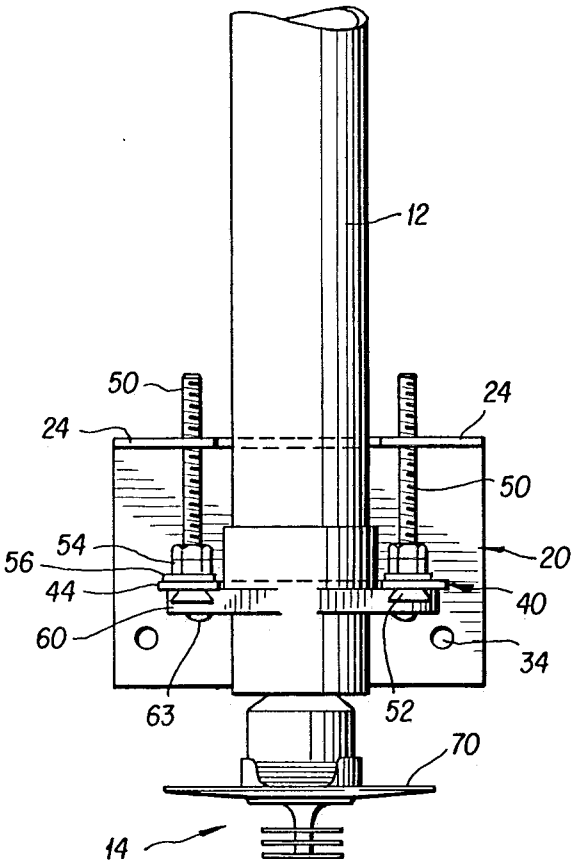
FIG. 4 shows the sprinkler head support system of FIG. 1 in greater detail.

Referring particularly to FIGS. 4 and 5, the shank of each of three threaded bolts 50 extends through the holes 44 and is threaded into the threaded apertures 26, with the heads 52 of the bolts extending downward below the second bracket 40. The heads 52 may, for example, be provided with conventional Phillips-type slots so that the bolts can be rotated by a Phillips-type screwdriver. Rotation of individual bolts 50 from below the bracket 40 causes the bracket 40 to angularly pivot about the axes 28 and 30 relative to the first bracket 20. This angular pivoting is limited by stop means which, according to this embodiment, are defined by a pair of nuts 54 tightened together to lock at a single position on the bolt. Washers 56 may also be provided.

Of course, although only two of the bolts 50 are shown in each of FIGS. 4 and 5, there are three such bolts, with the third being spaced from the illustrate two by 120°.

Figure 6:
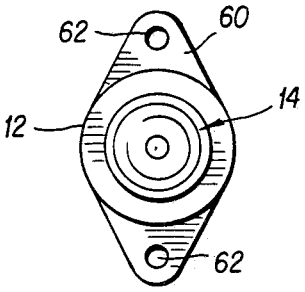
FIG. 6 is a bottom view of the sprinkler head and pipe according to the embodiment of FIGS. 1–5.

Referring particularly to FIG. 6, the downcomer pipe may be formed of, for example, PVC plastic and have a pair of opposing fingers 60 extending radially therefrom at a position slightly above the end having the sprinkler head 14 attached thereto. Holes 62 are formed in each of the fingers 60 and screws 63 extending through the holes can be threaded into threaded holes 64 in the ears 44 of the second bracket for firmly attaching the downcomer pipe to the second bracket 40. As a result, pivoting of the second bracket about the orthogonal axes 28 and 30 will result in identical pivoting of the end of the downcomer pipe 12 and its attached sprinkler head 14. Similarly, equal rotation of all of the three bolts 50 will raise or lower the second bracket 40 along the third axis 32, and with it the downcomer pipe 12 and attached sprinkler head 14. This movement is absorbed by the flexibility of the pipe 8 and downcomer 12.

Figure 7:
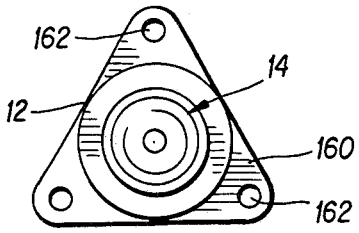
FIG. 7 is a bottom view of a sprinkler head and pipe according to a second embodiment.
Figure 8:
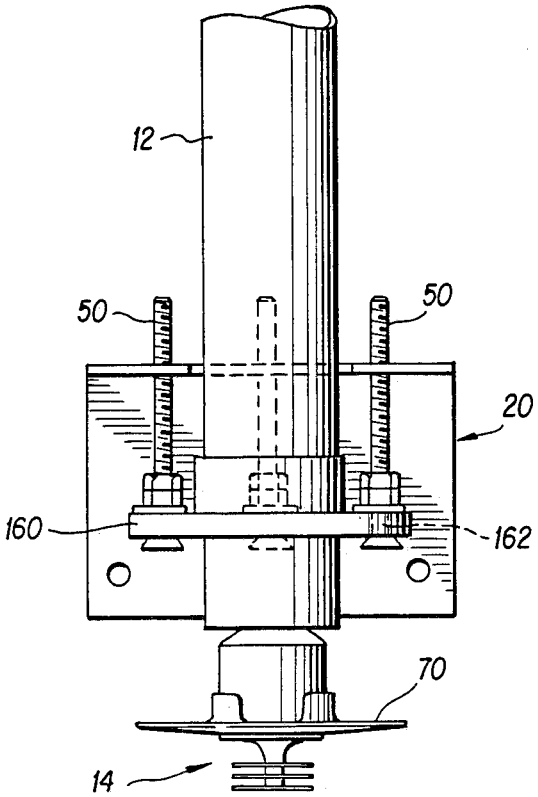
FIG. 8 is similar to FIG. 4, but shows the second embodiment.

A second embodiment of the invention can be seen with reference to FIGS. 7 and 8. As seen in FIGURE 7, the downcomer pipe 12 can be provided with three integrally formed fingers 160 which extend radially therefrom. The ears each are provided with a hole 162, the three holes 162 being evenly circumferentially spaced about the third axis 32, in the same manner as the holes 46 of the first embodiment. As a result, the second bracket 40 can be eliminated and the bolts 50 can extend directly through the holes 162. The remainder of the construction of this second embodiment is identical to that in the first embodiment.

Element 70 is decorative collar or bushing for the sprinkler head 14.

In use, the sprinkler pipe 8 and downcomer 12 having the sprinkler head 14 are installed on the truss work 2 prior to the installation of the false ceiling 4. At this time, the adjustable support assembly 16 is attached to the downcomer 12. This may be accomplished in the first embodiment by attaching the assembly of the first and second brackets 20 and 40, connected by the bolts 50, to the fingers 60, by use of the screws 63 passing through the cooperating holes 62 and 64. In the second embodiment, this is accomplished by passing the bolts 50 through the holes 162 of the fingers 160, assembling the bolts 54 and washer 56 thereon, and threading the bolts through the threaded apertures 26 of the first bracket 20. In each case, the first bracket 20 is attached to a portion of the truss work by use of the openings 34. For example, screws can be passed through the opening 34 and attached to the truss work.

The first bracket 20 may be oriented as shown in the figures, or reversed to define an upsidedown L-shape, depending upon the clearances available within the ceiling. Of course, the apparatus of the present invention could also be used for installing sprinkler heads in a side wall, in which case all of the dimensions would be rotated by 90°.

Following the installation of the false ceiling 4, with the protective collars 70 removed from the sprinkler heads 14, the position of the sprinkler heads relative to the false ceiling can be adjusted by passing the shaft of a screwdriver through the space between the sprinkler head and the edges of the hole in the false ceiling provided for the passage of the sprinkler head. By rotating the bolts 50 using the screwdriver, one can move the sprinkler head axially along axis 32, and can also pivot the sprinkler head about axes 28 and 30 until it is possible to mount the protective collar 70 on the sprinkler head with the protective collar resting flush against the bottom surface of the false ceiling 4. This may be done without any special tools, other than a screwdriver.

Moreover, the entire assembly is constructed of inexpensive sheet steel, nuts, bolts and washers, and can, if necessary, be assembled by a worker at a job site.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for three dimensionally adjustably supporting a member, comprising:

a first bracket having means for permitting free passage of said member therethrough and three threaded aperture means evenly spaced around said free passage means, wherein said first bracket comprises an angle-shaped member and wherein said means for permitting free passage comprise a first cut-out in one leg of said angle shape, said first cut-out defining a pair of opposing first ears on opposite sides of said first cut-out, each of said first ears having one of said threaded aperture means therein;

a second bracket having means for supporting said member and three holes evenly spaced around said supporting means;

three threaded bolts, each said bolt loosely passing through one of said holes and being threaded in one of said threaded aperture means; and stop means mounted on each of said three bolts between said first and second brackets, whereby said second bracket may pivot about two orthogonal axes and move along a third orthogonal axis relative to said first bracket within limits established by said stop means.

2. The apparatus of claim 1 wherein said stop means comprises at least one nut threaded on a respective said bolt between said first and second brackets.

3. The apparatus of claim 1 wherein said second bracket is spaced from said one leg of said angle shape along said third orthogonal axis and wherein said means for supporting said member comprise:

a second cut-out in said second bracket and defining a pair of opposing second ears on opposite sides of said second cut-out;

cooperating holes in said second ears for cooperating with fingers projecting from said member; and threaded means extending through said cooperating holes for fixing said fingers and second ears to one another, wherein each of said second ears has one of said three holes therein.

4. An apparatus for three dimensionally supporting a member, comprising:

a first bracket having a angle-shape including one leg having a first cut-out therein, said first cut-out defining a pair of opposing first ears on opposite sides of said first cut-out, three threaded aperture means in said first bracket and evenly spaced about said first cut-out, one of said aperture means extending through each of said first ears, another leg of said angle-shape having means for fixing said first bracket to an object;

a second bracket having a second cut-out therein, said second cut-out defining a pair of opposing second ears on opposite sides of said second cut-out, said second bracket further comprising three holes evenly spaced about said second cut-out, one of said three holes being in each of said second ears, and cooperating holes in said second ears for cooperating with fingers projecting from said member;

three threaded bolts, each said bolt loosely passing through one of said three holes and being threaded in one of said threaded aperture means; and stop means mounted on each of said three bolts between said first and second brackets, said stop means comprising at least one nut threaded on a respective said bolt, whereby said second bracket may pivot about two orthogonal axes and move along a third orthogonal axis relative to said first bracket within limits established by said stop means.

5. The apparatus of claim 4 in combination with said member, wherein said member comprises a fire sprinkler comprising:

a pipe extending along said third axis and capable of carrying liquid under pressure, said pipe extending through said first and second cut-outs;

a fire sprinkler head extending from an end of said pipe; and a pair of opposing fingers extending from said pipe in a direction transverse to said third orthogonal axis, each of said fingers having a hole, wherein said apparatus further includes threaded means extending through said holes of said fingers and said cooperating holes of said second ears for fixing said fingers and said second ears to one another.

6. An pipe member in combination with an apparatus for three dimensionally adjustably supporting said pipe member, comprising:

a first bracket having means for permitting free passage of said pipe member therethrough and three threaded aperture means evenly spaced around said free passage means;

three evenly circumferentially spaced fingers extending from said pipe member, each of said fingers having a hole therein;

three threaded bolts, each said bolt loosely passing through one of said holes of said fingers and being threaded in one of said threaded aperture means; and stop means mounted on each of said three bolts between said first bracket and said fingers, whereby said second pipe means may pivot about two orthogonal axes and move along a third orthogonal axis parallel to the length thereof relative to said first bracket within limits established by said stop means.

7. The apparatus of claim 6 comprising at least one nut threaded on a respective said bolt.

8. The apparatus of claim 6 wherein said first bracket comprises an L-shaped member and wherein said means for permitting free passage comprise a first cut-out in one leg of said L-shape, said first cut-out defining a pair of opposing first ears on opposite sides of said first cut-out, each of said first ears having one of said threaded aperture means therein.

9. The apparatus of claim 6 including a fire sprinkler head at an end of said pipe member.

10. A pipe member in combination with an apparatus for three dimensionally adjustably supporting said pipe member, comprising:

a first bracket having an angle-shape including one leg having a first cut-out therein, said first cut-out defining a pair of opposing first ears on opposite sides of said first cut-out, three threaded aperture means in said first bracket and evenly spaced about said first cut-out, one of said aperture means extending through each of said first ears, another leg of said angle-shape having means for fixing said first bracket to an object;

three evenly circumferentially spaced fingers extending from said pipe member, each of said fingers having a hole therein;

three threaded bolts, each said bolt loosely passing through one of said holes of said fingers and being threaded in one of said threaded aperture means; and stop means mounted on each of said three bolts between said fingers and said first bracket, said stop means comprising at least one nut threaded on a respective said bolt;

whereby said second pipe means may pivot about two orthogonal axes and move along a third orthogonal axis parallel to the length thereof relative to said first bracket within limits established by said stop means.

11. The apparatus of Claim 10 including a fire sprinkler head at an end of said pipe member.

* * * * *